United States Patent [19]

Wilhelm

[11] Patent Number: 4,582,024

[45] Date of Patent: Apr. 15, 1986

[54] FUEL HEATED WATER STORAGE TANK

[76] Inventor: Franz Wilhelm,
Albert-Schmidt-Allee 34, D-5630
Remsheid 11, Fed. Rep. of Germany

[21] Appl. No.: 612,789

[22] Filed: May 22, 1984

[30] Foreign Application Priority Data

Sep. 22, 1982 [DE] Fed. Rep. of Germany ... 8226584[U]
Sep. 17, 1983 [WO] PCT Int'l Appl. ..... DE83/00162

[51] Int. Cl.[4] ..... F22B 5/00

[52] U.S. Cl. ..... 122/13 R; 122/161; 122/162; 122/158

[58] Field of Search ..... 122/13 R, 16–19, 122/160–162, 158, 157

[56] References Cited

U.S. PATENT DOCUMENTS

| | | | |
|---|---|---|---|
| 353,996 | 12/1886 | Walp | 122/162 |
| 687,178 | 11/1901 | Damey et al. | 122/158 |
| 895,280 | 8/1908 | Mackley | 122/161 |
| 1,356,098 | 10/1920 | Trimble | 122/161 |
| 1,773,592 | 8/1930 | McDaniel | 122/161 |
| 2,213,189 | 9/1940 | Gudmand-Hoyer | 122/162 |
| 2,832,320 | 4/1958 | Thome et al. | 122/161 |

FOREIGN PATENT DOCUMENTS

| | | | |
|---|---|---|---|
| 252012 | 2/1927 | Italy | 122/161 |

*Primary Examiner*—Henry C. Yuen
*Attorney, Agent, or Firm*—Horst M. Kasper

[57] ABSTRACT

A fuel heated hot water storage tank with a water filled annular space (33) is disposed in a case (1). The center of the annular space is provided by a flame tube (5), which is heated with the waste gases of a burner. An annular heating space (10) for water of a heating system is disposed between the flame tube (5) and the inner wall (28) of the water container (33). The annular heating space (10) is formed as a double annular space in the shape of a U, where the two arms (11, 12) of the U are connected to each other in the lower region (34) via a redirection connection (14). A further annular space (26) is provided between the outer annular space (12) of the double annular space (10) at a heat insulating distance (27) from the outer annular space and the further annular space is located in a heat conducting connection to the water filled annular space (33). The heat insulating distance can be provided as a third annular space (27).

10 Claims, 1 Drawing Figure

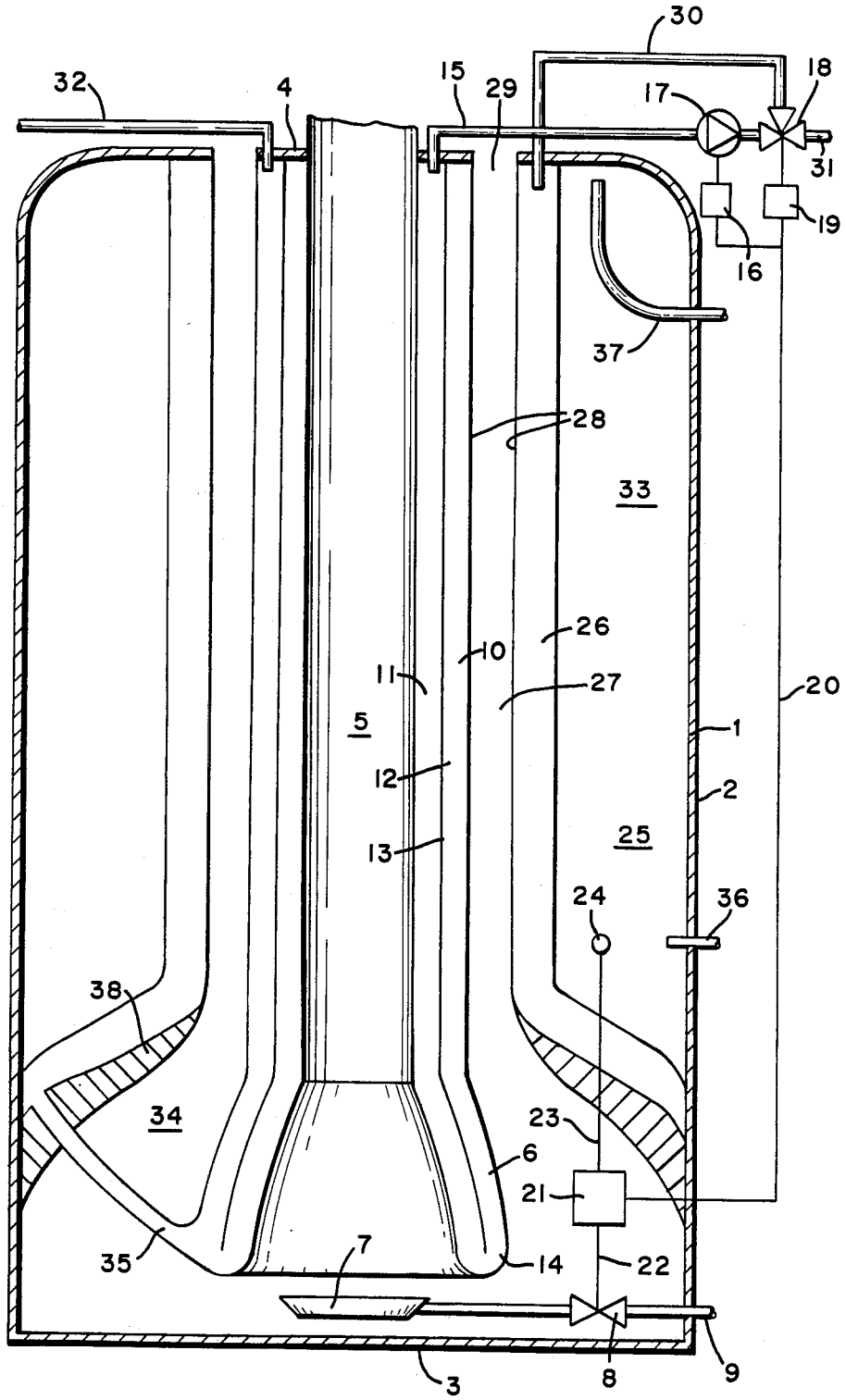
30
32
4
15
29
17
18
31
19
16
37
28
33
26
10
11
27
20
5
1
12
2
13
25
24
36
38
34
23
6
21
35
7
14
22
3
8
9

FUEL HEATED WATER STORAGE TANK

BACKGROUND OF THE INVENTION

1. Field of the Invention

The present invention relates to a fuel heated water storage tank according to the preamble of the main claim.

2. Brief Description of the Background of the Invention Including Prior Art

In general, such fuel heated water storage tanks are employed for providing heat to furnish hot use and service water. They are provided with a hollow cylindrical water storage tank, the center of which is provided by a flame tube, through which the waste gases of a burner run. The burner heats the water storage tank. It has been proposed to place a helical coil into the storage tank, which is connected to the central heating plant in order to be able to employ such a fuel heated water tank for the feeding of a central heating unit. It is a disadvantage that the full use and service water contents has to be heated up, before hot water can be delivered to the central heating plant installation.

SUMMARY OF THE INVENTION

1. Purpose of the Invention

It is an object of the present invention to avoid the disadvantage that the full use and service water has to be heated up, before hot water can be delivered to the central heating plant installation.

2. Brief Description of the Invention

The present invention provides a fuel heated hot water storage tank which comprises an outer storage space to be filled with water and disposed inside of a case, a flame tube disposed at the center of the storage space and to be used for the removal of the waste combustion gases, a burner disposed near the bottom end of the flame tube, a double annular heating up space with the shape of a U for water of a heating system disposed between the flame tube and the inner wall of the outer annular space to be filled with water, where the two arms of the U are connected in the lower region via a redirection section, and a further annular space provided between the outer annular space of the double annular space and the outer annular space to be filled with water which is disposed at a heat insulating distance from the outer annular space of the double annular space and which is in thermally conducting connection to the outer annular space to be filled with water.

A third annular space can be provided for a heat insulating distance between the outer annular space of the double annular space and the further annular space. The third annular space can be filled with air and is preferably provided as a combustion air feed line for the burner. All annular spaces can be surrounded by the case on all sides and the case can be closed and furnished only with openings for an air intake and a waste gas outlet at the top side. Outwardly diverging lower ends of the annular spaces can be formed inside of the case. An insulation can be disposed in the diverging region of the annular spaces.

A connection line can be provided to the redirection point of the double annular space disposed at the bottom end of the further annular space. The wall of the third annular space can be provided with an insulation on the two sides. The walls of the annular spaces can comprise aluminum or steel sheet metal. The walls of the annular spaces can comprise ceramic material. Upon use of an atmospheric pressure burner the walls of the annular spaces can be disposed vertically.

The burner can be a blower-burner, and the axes of the annular spaces can be disposed about horizontally during operation. Tube connection ports can be provided at the top side of the case for the double annular space with its inner annular space and its outer annular space and for the further annular space. A liquid circulating pump can be connected to the tube connection port of the inner annular space of the double annular space, a three-way switching valve can be connected to the liquid circulating pump and to the tube connection of the outer annular space of the double annular space via heating radiators of a heating plant, and a connection line can be connected to a port of the liquid circulating pump and to the further annular space. A concentric tube line can be connected at the upper side of the case and to the interior of the flame tube and to the further annular space for providing the combustion air intake line and the exhaust gas output line.

There is also provided a method for heating hot water in a storage tank with burning fuel which comprises heating a flame tube with a fuel burner generating a hot gas, transferring thermal energy from the hot gas to the inner arm of a double annular space, circulating water with a liquid circulation pump coming from a three-way valve into a further annular space surrounding the double annular space, guiding the water in the further annular space to a redirection point of the double annular space, passing the water through the inner annular space, feeding the water from the inner annular space to a feed line.

The method can further comprise switching the three-way valve to heating plant operation, circulating hot feedline water coming from the inner annular space of the double annular space into the feed line of a heating system, returning the return water from the heating plant to the outer arm of the double annular space at its upper end.

Further embodiments and particularly advantageous developments of the invention are the subject matter of the subclaims or can be gathered from the following description. The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which is shown one of the various possible embodiments of the present invention:

FIG. 1 is a view of a schematic longitudinal sectional representation of a gas heated storage tank.

DESCRIPTION OF INVENTION AND PREFERRED EMBODIMENT

In accordance with the present invention a fuel heated hot water storage tank is provided with a water filled annular space disposed in a case, where the center of the case contains a flame tube heated with the exhaust air of a burner. An annular heating space (10) for water of a heating system is provided between the flame tube (5) and the inner wall (28) of the water container (33).

The annular heating space is preferably provided as a double annular space 10 formed as a U, where the two arms (11,12) are connected to each other in the lower region (34) via a redirection (14). An additional annular space (26) can be provided inside of the water storage tank (33) as a heat exchanger space for heating of the water storage tank (33). The further annular space (26) and the double annular space (10) are separated by a third annular space serving as a conduit for feeding in combustion air.

Preferably, all annular spaces are surrounded by a case (1) which is closed and which is provided with only openings for an air supply (29) and a waste gas outlet (5) at the upper side (4). An insulation (38) for the water storage tank (33) is provided between the third annular space (27) and the further annular space (26). The insulation (38) is provided in the diverging range at the lower end (34) of the diverging annular spaces (11, 12, 27, 26). A connection line (35) to the redirection point (14) of the double annular space (10) is disposed at the lower end (34) of the further annular space (26).

Preferably, the walls (28) of the third annular space (27) are provided with an insulation on the two sides. The walls (28) of the annular spaces can comprise steel or aluminum sheet metal or a ceramic material. The axes of the annular spaces can be vertical upon use of a burner operating with atmospheric air or, alternatively, the axes of the annular spaces are disposed horizontally upon use of a blower burner.

More specifically, a fuel hot water storage tank with a water filled annular space (33) is disposed in a case (1), where the center of the annular space is provided by a flame tube (5) heated with the waste gases of a burner, where an annular heating space (10) for water of a heating system is disposed between the flame tube (5) and the inner wall (28) of the water container (33) and the annular heating space (10) is formed as a double annular space (10) in the shape of a U, where the two arms (11, 12) of the U are connected to each other in the lower region (34) via a redirection section (14). A further annular space (26) can be provided between the outer annular space (12) of the double annular space (10) at a heat insulating distance (27), which further annular space is located in a heat conducting connection to the water filled annular space (33).

The heat insulating distance can be provided as a third annular space (27). The third annular space (27) can be filled with air and provided as a combustion air feed for the burner. Preferably, all annular spaces are surrounded by a case (1) from all sides, which case is closed and is provided only with feedthroughs for air intake (29) and a waste gas exhaust outlet (5) at the surface (4). The insulation (38) can be provided in the diverging region at the lower end (34) of diverging annular spaces (11, 12, 27, 26). Preferably, a connection line (35) to the redirection point (14) of the double annular space (10) is disposed at the lower end (34) of a further annular space (26). The walls (28) of the third annular space (27) can be provided with an insulation on the two sides. The walls (28) of the annular spaces can comprise steel or aluminum metal sheets or can be formed from a ceramic material. The axes of the annular spaces can be disposed vertically upon use of a burner operating at atmospheric pressure. Alternatively, the axes of the annular spaces can be disposed horizontally.

Both the double annular space (10) with its inner annular space and its outer annular space and the further annular space (26) are provided with tube ports at the top side of the case (1) of the water storage tank. The tube connection (15) of the inner annular space of the double annular space (10) is led to a three-way valve (18) under incorporation of a circulating pump (17), where one outlet of the three-way valve (18) is connected to a further annular space (26) via a connection line (30) and where the other outlet of the three-way valve (18) is connected to the tube connection (32) for the outer annular space of the double annular space via radiating bodies of a heating plant. The combustion air feed inlet and the exhaust gas outlet can be provided via a concentric tube line, which ports at the top side (4) of the case (1) and which is connected to the interior of the flame tube (5) and to the further annular space (27).

According to the preferred embodiment of FIG. 1, the gas heated storage tank is provided with a case 1 having an insulating layer. The case 1 comprises a cylinder jacket 2, a floor plate 3 and a cover plate 4 provided with recesses, which are connected to each other on all sides in a tight way.

The central interior part of the case 1 is provided by a flame tube 5, to which a gas burner 7 is coordinated at the lower expanding end 6, which is fed via a gas line 9 provided with a solenoid valve 8 for the fuel. In addition to gas as a carrier of energy also fuel or a solid fuel could be used. The wall of the flame tube is formed by a heat exchanger with a double annular space 10 extending around the cylinder jacket of the flame tube. The double annular space 10 forms two arms 11 and 12, which are separated from each other via a separating sheet metal piece 13 and which show a U-shape with a redirection 14 located at the bottom in the area of the burner. A feed line 15 is connected at the inner arm 11 of the double annular space in the area of the cover 4. A liquid recirculation pump 17 driven by a motor 16 and a three-way switch valve are disposed in the line 15. The three-way switch valve 18 can be adjusted by a servomotor 19. The motor 16 and, respectively, the servomotor 19 are connected to an automatic control and control provision 21 via a signal line 20. The automatic control and control provision 21 is connection via a line 21 to the solenoid valve for the burner 7 and to a temperature sensor 24 via a measurement line 23. The temperature sensor 24 is disposed inside of the water storage tank. The flame tube 5 and the double annular space 10 form cylinder or, respectively, hollow cylindric spaces concentrically to a joint symmetry axis. A further annular space 26 surrounds the double ring space 10 and the further annular space 26 is separated from the double ring space 10 via a third annular space 27. The individual spaces 26, 17, 11 and 12 are separated from each other with annular sheet metal walls 28. While the third annular space is connected to the atmosphere via a ring opening 29 in the area of the cover, the further annular space 26 is connected to a port of the three-way valve 18 via a return line connection 30, which is also provided in the cover 4. A feed line 31 runs from the three-way valve 18 to a user provision, which can comprise a series and/or parallel connection of a plurality of heating radiators and which can be connected on the return side to a return line 32, the connecting port of which is connected to the outer arm 12 of the double annular space 10 near the cover.

The inner space 25 of the water storage tank 33 extends around the further annular space 26. The water storage tank 33 is inwardly separated by the separation sheet 28 of the further annular space 16 and to the outside via the jacket 2 of the case 1.

A connecting line 35 is provided in the lower region 34 of the case 1, which extends from about the bottom location of the further annular space 26 to the redirecting location 14 between the two arms 11 and 12 of the double annular space 10. Both the arms 11 and 12 as well as the annular spaces 26 and 17 expand in the lower range 34, as does the flame tube 5. This expansion occurs at the expense of the inner space 25 of the water storage tank 33, which does not reach down to the region of the floor 3, but which ends at a distance away from the floor. A cold water feed pipe 36 runs into the inner space 25 in its lower region and a use water supply line 37 runs off from the inner space 25 in its upper most region.

The inner side of the further annular space 26 disposed toward the third annular space can be provided with an insulating layer 38 in the lower region 34. The temperature sensor 24 is disposed in the lower region 34 of the inner space 25 of the hot water storage tank 33.

The fuel heated hot water storage tank performs the following function: If this storage tank is only used for the furnishing of hot use water and the temperature sensor 24 calls for heat, then adjustment signals result from the control and automatic control provision 21 for the opening of the solenoid valve 8, for the starting of the motor 16 of the circulation pump 17, for the adjustment of the three-way valve 18 in another direction, such that the feed line is shut off. The burner starts to operate and sucks in fresh air via the air opening 29 and the third annular space 27. The exhaust gas produced by the burner 7 and ascends in the flame tube 5 and leaves the water storage tank via a waste gas pipe continuing the flame tube and the waste gas pipe not shown here.

The waste gases of the burner thus heat the flame tube 5, from which heat is transferred to the inner arm 11 of the double annular space 10. The water circulates here driven by the circulating pump, which water passes from the three-way valve via line 30 to the further annular space 26. From here the water runs via the connecting line 35 to the redirecting point 14 of the double annular space 10. The water leaves the double annular space 10 at the upper end of the inner arm 11 and, in fact, via the feedline 15. It is pointed out that the pump 17 can also be disposed in the return line 30.

Thus the circulating water contributes to accept the heat from the hot exhaust gases of the burner passing through the flame tube and on the other hand to deliver them via the sheet 28, which separates the inner space 25 of the storage container 33 from the hollow cylindrical area of the further annular space. Thus an indirect heating of the use water occurs, which can be tapped from the hot water distributor port 37 by pressing in of fresh cold water via the feed line port 36.

If in contrast the heating plant is to be operated with the fuel heated water storage tank, then the three-way valve 18 is switched accordingly by the servomotor 19. The pump delivers then heated feedline water from the line 15 into the feedline 31 for running to the heating bodies not shown here, from where the water is led via the return line 32 to the outer arm 12 of the double annular space 10 and in particular to its upper end near the cover side. This cool return water flows through the two arms of the double annular space and leaves the water storage tank via the feed line 15.

No heating of the use water occurs according to this circuit. The water stored in the interior space 25 of the water storage tank 33 is substantially protected against heat loss versus the cool fresh air passing through the third annular space via the insulation 38. It would be possible to provide the insulation over the full height of the case 1 at the sheet 28, which separates the third annular space 27 on the outside against the further annular space 26, such that the medium flowing into the further annular space 26 in case of use water heating is not cooled by the fed in fresh combustion air. A like insulation could be provided on the outside of that sheet 28, which limits the outer arm 12 of the double annular space 10.

It is particularly well suitable based on the concentric construction of the individual annular spaces to connect the apparatus on the waste gas and waste air side via concentric pipes to chimneys or air shafts and to dispose therein a fresh air or waste gas blower or to work with a waste air flap.

Ceramic tubes can also be employed instead of ring sheet metal, which can be made from steel or aluminum. It is also possible to let the water storage tank operate when turned around by an angle of 90 degrees such that the symmetry axis is not vertically, but horizontally disposed and the burner can be a gas or oil blower burner.

In case the cooling via the air feed in the third annular space should be too large, then the opening 29 can be closed and a new feedline opening can be disposed in the area of the floor cover 3.

A thermal separation of the use water from the water feeding the heating system becomes possible via the air carrying annular space 27. This results in the advantage that the use water can be kept at temperature different from the water feeding the heating system and in particular at a higher temperature.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel heated hot water storage tank comprising a case;

an outer storage space to be filled with water and disposed inside the case;

a flame tube disposed at the center of the storage space and to be used for the removal of the waste combustion gases; a burner disposed near the bottom end of the flame tube; a double annular heating up space with the shape of a U for water of a heating system disposed between the flame tube and the inner wall of the outer annular space to be filled with water, where the two arms of the U are connected in the lower region via a redirection section;

a further annular space provided between the outer annular space of the double annular space and the outer annular space to be filled with water which is disposed at a heat insulating distance from the outer annular space of the double annular space and which is in thermally conducting connection to the outer annular space to be filled with water;

a third annular space providing the heat insulating distance between the outer annular space of the double annular space and the further annular space, where the third annular space is filled with air and is provided as a combustion air feed line for the burner;

tube connection ports provided at the top side of the case for the double annular space with its inner annular space and its outer annular space and for the further annular space;

a liquid circulating pump connected to the tube connection port of the inner annular space of the double annular space; a three-way switching valve connected to the liquid circulating pump and to the tube connection of the outer annular space of the double annular space via heating radiators of a heating plant; and a connection line connected to a port of the liquid circulating pump and to the further annular space.

2. The fuel heated hot water storage tank according to claim 1 wherein all annular spaces are surrounded by the case on all sides;

where the case is closed and is furnished only with openings for an air intake and a waste gas outlet at the top side.

3. The fuel heated hot water storage tank according to claim 1 further comprising outwardly diverging lower ends of the annular spaces inside of the case; and an insulation disposed in the diverging region of the annular spaces.

4. The fuel heated hot water storage tank according to claim 3 wherein the wall of the third annular space is provided with an insulation on the two sides.

5. The fuel heated hot water storage tank according to claim 1 wherein the walls of the annular spaces comprise aluminum or steel sheet metal.

6. The fuel heated hot water storage tank according to claim 1 wherein the walls of the annular spaces comprise ceramic material.

7. The fuel heated hot water storage tank according to claim 1 wherein upon use of an atmospheric pressure burner the walls of the annular spaces are disposed vertical.

8. The fuel heated hot water storage tank according to claim 1 wherein the burner is a blower-burner, and wherein the axes of the annular spaces are disposed about horizontally during operation.

9. The fuel heated hot water storage tank according to claim 1 further comprising a concentric tube line connected to the upper side of the case and to the interior of the flame tube and to the further annular space for providing the combustion air intake line and the exhaust gas output line.

10. The fuel heated hot water storage tank according to claim 1 further comprising a connection line to the redirection point of the double annular space disposed at the bottom end of the further annular space.

* * * * *